US005881589A

United States Patent [19]

Clark et al.

[11] Patent Number: 5,881,589

[45] Date of Patent: Mar. 16, 1999

[54] GEAR DRIVEN BOLT WITHDRAWAL FOR AN ELECTRONIC COMBINATION LOCK

[75] Inventors: Thomas R. Clark; Gerald L. Dawson; Walter R. Evans, all of Lexington; James P. Redden, Versailles, all of Ky.

[73] Assignee: Mas-Hamilton Group, Lexington, Ky.

[21] Appl. No.: 873,332

[22] Filed: Jun. 12, 1997

[51] Int. Cl.[6] ..... E05B 49/02

[52] U.S. Cl. ..... 70/278; 70/283; 70/303 A; 70/333 R

[58] Field of Search ..... 70/277, 278, 283, 70/333 R, 303 A; 292/172, 144

[56] References Cited

U.S. PATENT DOCUMENTS

| | | | |
|---|---|---|---|
| 656,011 | 8/1900 | Carleton . | |
| 1,266,159 | 5/1918 | Rittmeyer | 70/190 |
| 2,082,806 | 6/1937 | Michel | 70/278 |
| 2,575,674 | 11/1951 | Miller | 70/284 |
| 3,733,861 | 5/1973 | Lester | 70/153 |
| 3,939,679 | 2/1976 | Barker et al. | 70/277 |
| 3,947,060 | 3/1976 | Zimmer et al. | 292/144 |
| 4,248,068 | 2/1981 | Esser et al. | 70/134 |
| 4,384,465 | 5/1983 | Muus | 70/129 |
| 4,416,127 | 11/1983 | Naveda | 70/726 |
| 4,616,491 | 10/1986 | Genest | 70/276 |
| 4,904,984 | 2/1990 | Gartner et al. | 70/333 R |
| 5,265,452 | 11/1993 | Dawson et al. | 70/278 |
| 5,473,922 | 12/1995 | Bair et al. | 292/144 |
| 5,480,198 | 1/1996 | Wydler et al. | 292/144 |
| 5,487,290 | 1/1996 | Miller et al. | 292/144 |
| 5,592,838 | 1/1997 | Clark et al. | 70/278 |
| 5,653,135 | 8/1997 | Miller et al. | 292/144 |
| 5,715,716 | 2/1998 | Miller et al. | 70/303 A |
| 5,720,194 | 2/1998 | Miller et al. | 70/303 A |

*Primary Examiner*—Darnell M. Boucher
*Attorney, Agent, or Firm*—Laurence R. Letson

[57] ABSTRACT

A gear driven bolt withdrawal mechanism for an electronic lock is disclosed wherein an electromagnetic device such as an electromagnetic device displaces a partial gear into a position to be engaged by a manual drive. The partial gear, in turn, drives subsequent gears in a gear train to engage a gear with teeth on a rack attached to or a part of the bolt of the lock. The restoration of the bolt is ensured by a physical engagement between a portion of the drive cam and a portion of the bolt to force the bolt to its extended position upon locking; a displaceable slide is disposed in blocking relationship to the bolt whenever the bolt is fully extended to prevent end pressure from displacing the bolt without entry of a valid combination into the electronic controls of the lock.

5 Claims, 7 Drawing Sheets

GEAR DRIVEN BOLT WITHDRAWAL FOR AN ELECTRONIC COMBINATION LOCK

FIELD OF THE INVENTION

This invention relates to combination locks and, more specifically, to electronic combination locks with positive bolt withdrawal drives.

BACKGROUND OF THE INVENTION

Locks of the type to which the subject invention relates typically employ dial cams attached to a spindle and a dial or dial knob as well as lock levers or bolt levers, which are selectively engagable with the dial cam, to effect the withdrawal of the bolt to cause the lock to unlock. The bolt levers typically are moved to engage the dial cam by gravity or various mechanisms; such mechanisms include solenoids, springs and slides.

The solenoids and/or springs may be used to physically displace the lock lever or bolt lever while the slides typically are engaged with the bolt lever and cause the bolt lever to be pivoted about its connection to the bolt and into engagement with the dial cam; in some instances gravity is used to cause the displacement of the bolt lever.

The type of bolt lever mechanism where the bolt lever must be moved to engage the drive cam presents several aspects which may prove to be disadvantageous with respect to maintaining security of the lock. Bolt levers engaging dial cams for purposes of bolt withdrawal are subject to inadvertent dislocation of the lever, thereby inadvertently connecting the bolt lever with the dial cam and permitting opening of the lock without entry of a valid combination. Additionally, the contact of the bolt lever with the drive cam through the normal operation of the lock may provide characteristic sounds or noise which may be analyzed to disclose the relative position of elements within the lock, thus aiding in the defeat of such a lock. Further, the bolt lever type bolt withdrawal mechanism may be subject to end bolt pressure or end bolt force causing the bolt lever to be displaced under the influence of forces exerted on the end of the bolt, thus yielding to the end bolt pressure and allowing the lock to be physically forced opened.

OBJECTS OF THE INVENTION

It is an object of the invention to provide a positive drive for the withdrawal of the bolt.

It is another object of the invention to block the movement of the bolt whenever subjected to end bolt forces.

It is an additional object of the invention to ensure positive bolt extension directly from the cam wheel or dial cam of the lock mechanism.

It is a further object of the invention to prevent sound or noise generation which may compromise the security of the lock during the rotation of the dial cam.

SUMMARY OF THE INVENTION

An electronic lock incorporates the invention. The electronic lock has a component thereof, a stepper motor, which acts to rotate a partial gear to position the partial gear in a position whereby it may be driven rotationally by a series of gear teeth on the periphery of a manually rotated dial cam. The partial gear will mesh with the dial cam gear and be driven by the rotation of the dial cam. The partial gear, in turn, will drive a coaxially disposed second gear. The second gear is driven by a pin/slot, lost motion, arrangement wherein the second gear carries a pair of pins that reside in a pair of slots formed into the partial gear. The rotation of the partial gear is a lost motion rotation for a short portion of the movement, at which point the pins and the slot ends are engaged to provide a positive drive of the second gear.

In turn, the second gear is meshed with an idler gear. The idler gear further is meshed and mated with a rack which either is attached to or forms a portion of the bolt of the lock.

Rotation of the drive cam provides the necessary drive forces to drive the gear train gears in their respective directions of gear rotation and, accordingly, provides the forces necessary to drive the rack of the bolt to withdraw the bolt or conversely to extend the bolt, depending upon the direction of rotation of the drive cam. In order to ensure that the bolt is only withdrawn at appropriate times, whenever a valid combination has been entered into the electronics of the electronic lock and not at other times, the stepper motor controls the engagement of the partial gear with the gear teeth on the drive cam. During periods that the lock is to be left in a secure condition, the partial gear is disposed in a position whereby the teeth on the drive cam or dial cam cannot engage the teeth on the partial gear.

Once the stepper motor is actuated and the partial gear meshes with the dial cam gear teeth, the partial gear will rotate and will cause a cam roller mounted on the second gear, driven by the partial gear, to displace a slideable slide element. The slide element acts as an interlock to prevent bolt retraction until such time as the slide has been displaced out of blocking relationship with the bolt. The displacement of the slide can only occur upon the rotation of the second gear and that rotation can only occur under the influence of the rotation of the partial gear driven by the dial cam.

Once the slide is disposed in an insecure position, the bolt may be withdrawn by driving the gear train to retract the bolt. Upon restoration of the bolt to its locked position, the rotation of the dial cam is used to drive the gear train in its opposite direction and to extend the bolt through the gear drive. To ensure that the bolt is fully extended, thereby permitting the slide to be restored, a cam eccentric roller carried on the dial cam engages the end of the rack and physically forces the bolt to its extended or home position.

Once the bolt is extended, the spring loading on the slide restores it to the locked position blocking movement of the bolt, thereby preventing the retraction of the bolt.

A more complete understanding of the invention may be derived from the attached drawings and the detailed description of the preferred embodiment of the best mode contemplated by the inventors for carrying out the invention which follows:

DETAILED DESCRIPTION OF THE INVENTION

Figure 1:
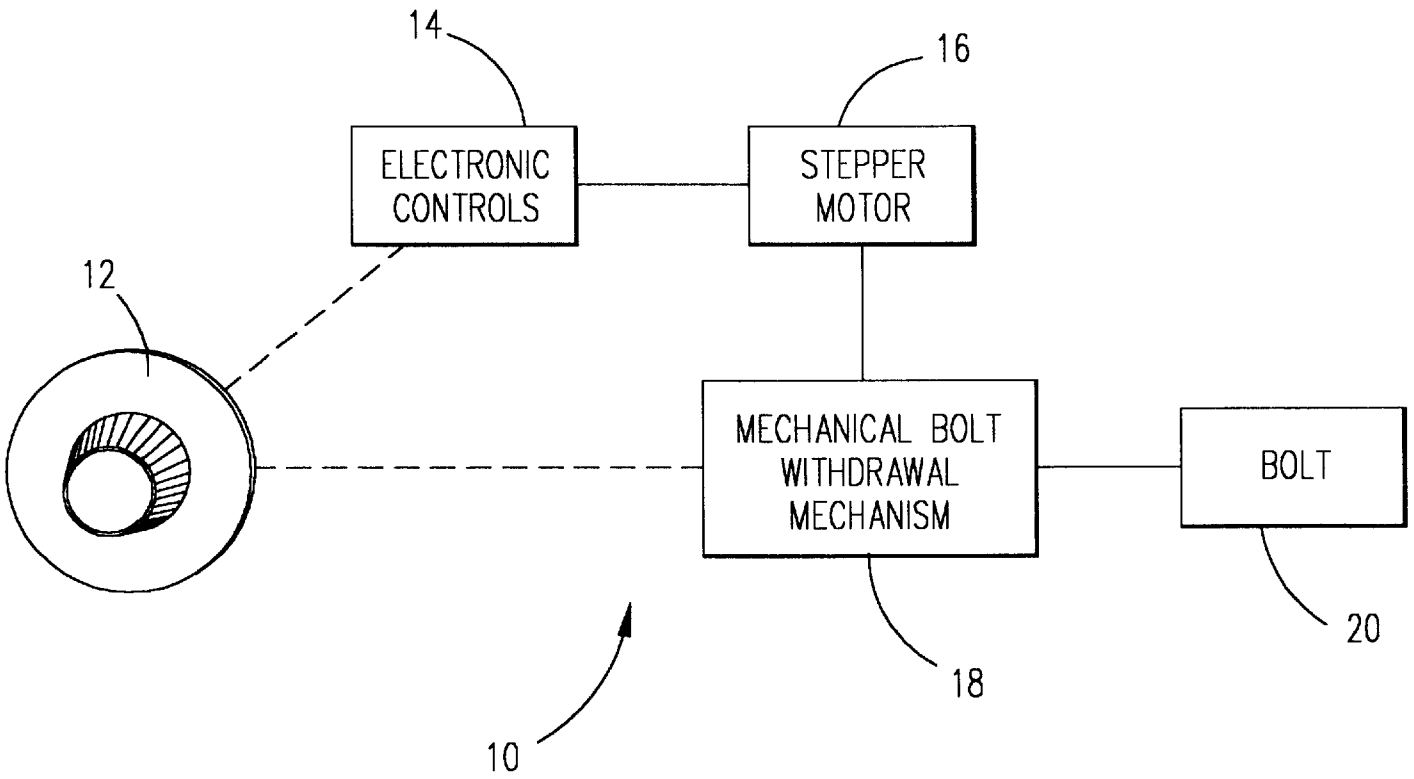
FIG. 1 is a diagrammatic illustration of an electronic lock.

Referring initially to FIG. 1, the lock 10 is illustrated in a schematic form. Dial 12 is mechanically connected to the electronic controls 14 to drive the input such as a pulse generator. The electronic controls 14 receive the mechanical input from dial 12 and utilize it to form electrical commands to the electronic controls 14 such as digital pulses, and thereby to receive the combination from the operator. The electronic controls further compare the combination with a stored combination for authorization to enter any container upon which the lock 10 may be mounted. The electronic controls 14, among other things, have an electrical signal output to a stepper motor 16. The stepper motor 16 acts to control the mechanical bolt drive mechanism 18. Mechanical bolt drive mechanism 18 then controls and effects either the withdrawal of bolt 20 to cause the lock 10 to open or the extension of bolt 20 to cause the bolt 20 to be locked or returned to the locked position.

The stepper motor 16 is not shown in subsequent figures, however, the mechanical bolt drive mechanism 18 and the connection between the dial 12 and the mechanical bolt drive mechanism 18 are illustrated in more specific detail in FIGS. 2 through 7.

Figure 2:
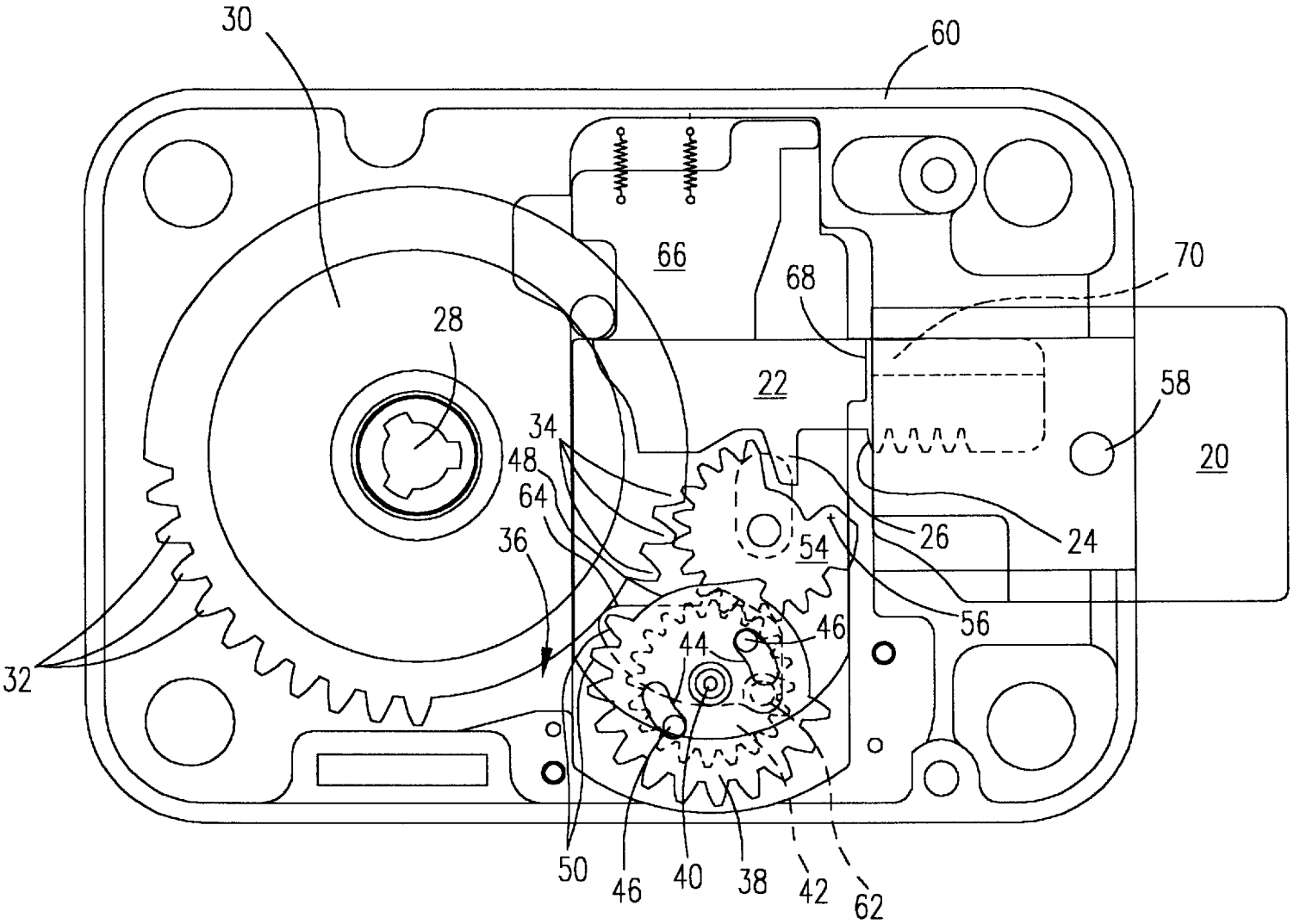
FIGS. 2 through 7 are illustrations of the geared bolt withdrawal mechanism in various stages of operation and illustrated as part of the electronic lock shown in FIG. 1.

Referring at this point to FIG. 2, the lock's mechanical drive elements are illustrated. Bolt 20 is shown in its extended and locked position. Bolt 20 carries a rack 22, either as a part thereof or as a member added thereto. Rack 22 incorporates a series of gear teeth 24 as well as an enlarged tooth 26.

The lock 10 is provided with a manual input through shaft 28 which is drivingly engaged with dial 12, as shown in FIG. 1. Shaft 28 rotates drive cam 30 which, in turn, incorporates on its periphery a first set gear teeth 32 and a second set of gear teeth 34.

Whenever the stepper motor gear 38 is in its deactivated position, segment 48 which is toothless is in proximity to the periphery of drive cam 30.

Intermediate the first set of gear teeth 32 and the second set of gear teeth 34 is an open span 36 having no gear teeth and a radius approximately the same as the base of the gear teeth 32, 34. Span 36 provides a clearance so that partial gear 38 may be rotated into position for engagement with gear teeth 32 and so that drive cam 30 may be rotated through a limited arc without engaging any of the drive gear train.

FIG. 2 shows the stepper motor gear 38 in a position corresponding to an actuated position. Stepper motor gear 38 is rotated or actuated by the stepper motor 16 in an amount equal to 36 degrees of rotation in order to actuate the lock 10 for unlocking. When stepper motor gear 38 is rotated in a clockwise direction by the stepper motor 16 (in FIG. 1) gear 38 will rotate about its axis 40 and rotate relative to gear 42. The relative motion between stepper motor gear 38 and gear 42 is permitted by lost motion slots 44 and pins 46 and permits the set-up of stepper motor gear 38 for engagement by drive cam 30 without restriction by the idler gear 42.

Once the stepper motor 16 has been actuated and stepper motor gear 38 has been rotated in a clockwise direction and is in the position as illustrated in FIG. 2, the initial teeth 50 are presented in close proximity to segment 36 of drive cam 30 so that the teeth in set 32 will engage therewith upon counterclockwise rotation of the drive cam 30.

Should the drive cam 30 be rotated in a clockwise direction, teeth 34 will ensure the resetting of stepper motor gear 38. Stepper motor gear 38 drives idler drive gear 42 through the pin 46 and slot 44 arrangement whenever stepper motor gear 38 is rotated by drive cam 30. Gear 42 meshes with and drives partial gear 54.

During the rotation of partial gear 54, the slide 66 is being moved downwardly by roller follower 62.

Partial gear 54 is provided with an enlarged tooth 56 for engagement with an enlarged tooth 26 on rack 22. Enlarged tooth 56 and enlarged tooth 26 provide an engagement point which produces a larger mechanical advantage and lower torque requirement than the gear 54 and rack 22 would produce and is more nearly in-line with the ball detent 58 in bolt 20 than the engagement points of the gear teeth 24 on rack 22. By more closely aligning the force exerted on enlarged tooth 26 with ball detent 58 than would be the case if teeth such as 24 were extended all along rack 22, the forces of overcoming the ball detent 58 are reduced and there is less chance of creating a bind between bolt 20 and lock case 60.

Roller follower 62, carried or mounted on idler gear 42, is engaged in cam opening 64 formed into slide 66. As illustrated in FIGS. 2 through 7, slide 66 is capable of reciprocation in a vertical direction, and is driven in a generally downward direction as illustrated by the rotation of gear 42 and the engagement of roller follower 62 with the cam opening 64. As roller follower 62 is rotated in a clockwise direction, the effect is to pull slide 66 downward removing abutment face 68 from engagement with blocking member 70, a part of rack 22 or bolt 20 depending upon the fabrication technique used to fabricate bolt 20.

Figure 3:
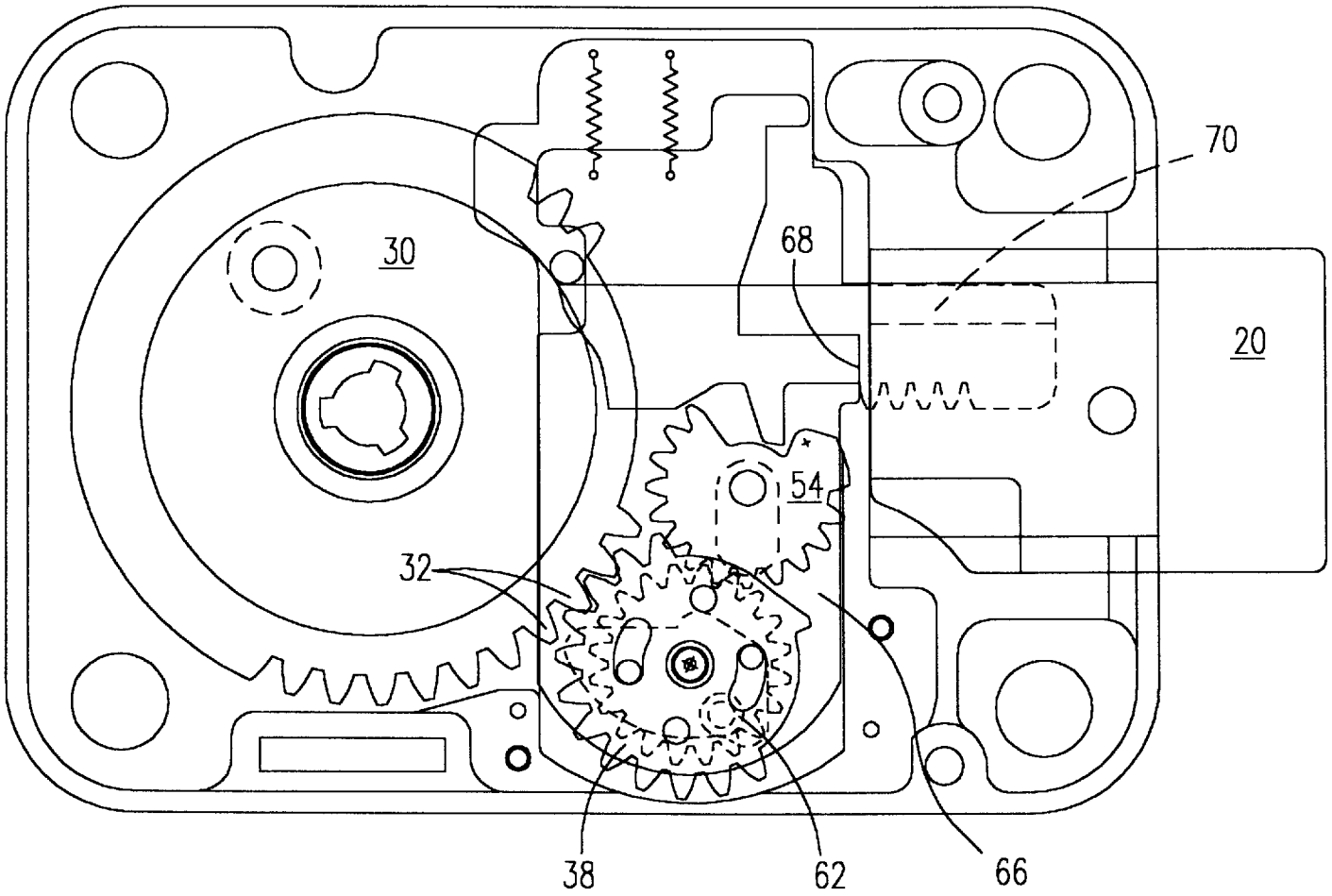

FIG. 3 illustrates the mechanical mechanism in a condition whereby the drive cam 30 has been rotated in a counterclockwise direction sufficiently to mesh the gear teeth 32 with stepper motor gear 38 and rotate stepper motor gear 38 sufficiently to drive roller follower 62 to displace slide 66 downward and thus remove abutment surface 68 from an abutting relationship with blocking member 70 on bolt 20.

Figure 4:
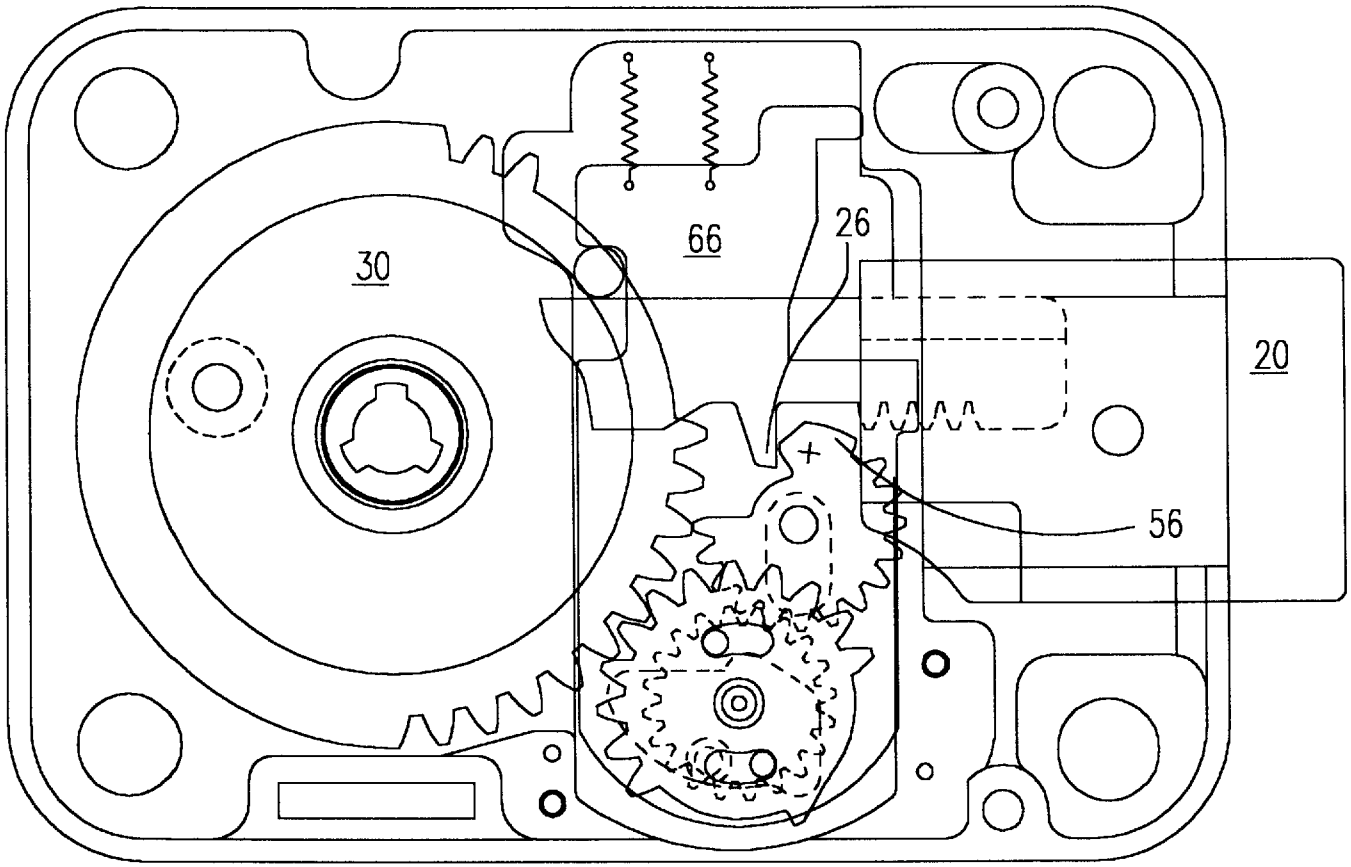

FIG. 4 illustrates a continuation of the movement of drive cam 30 and the consequent driving of the gear train such that enlarged tooth 56 engages enlarged tooth 26 and has begun to displace bolt 20 from its fully extended position.

Figure 5:
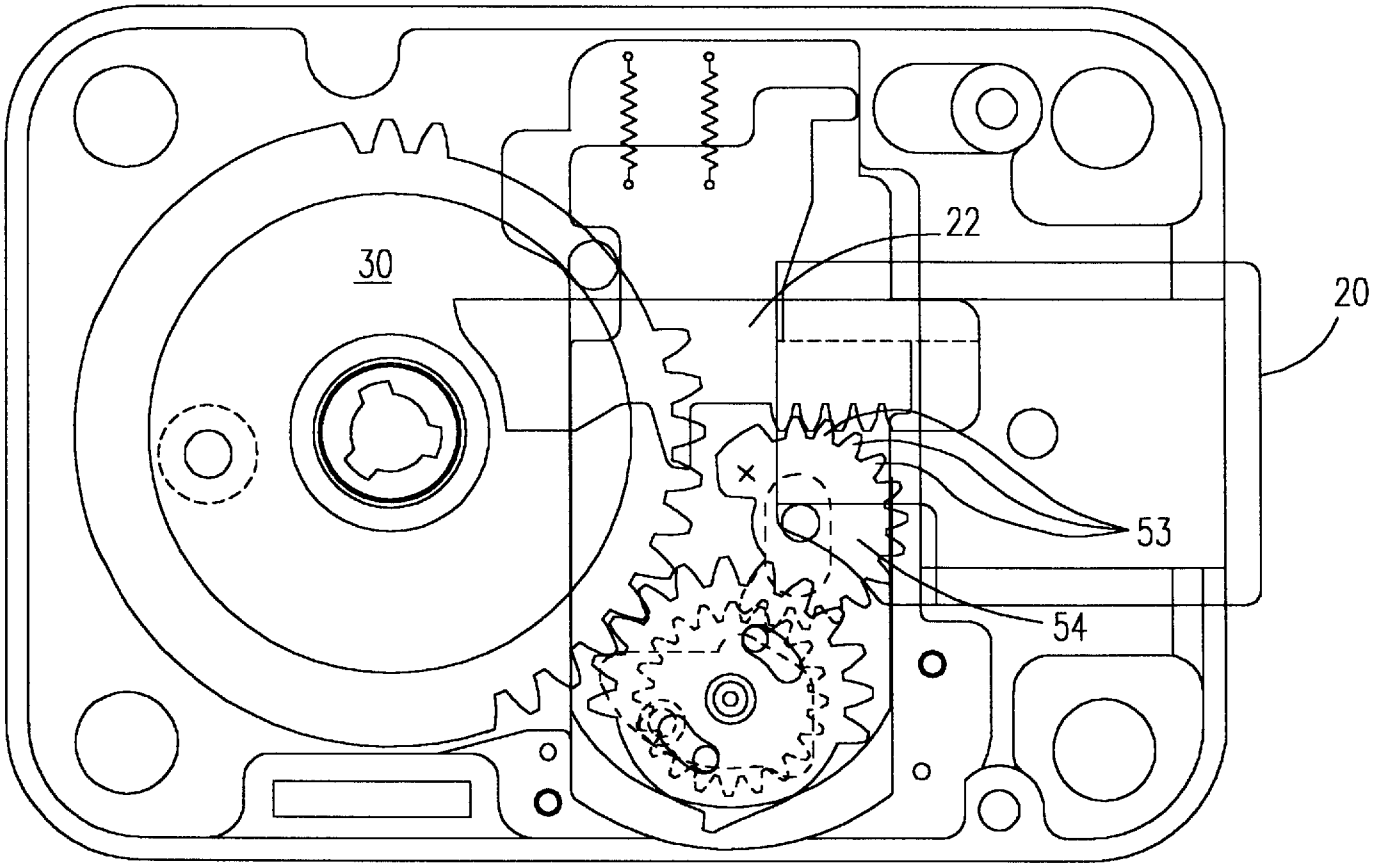

FIG. 5 illustrates the mechanical elements of the bolt withdrawal mechanism 18 in the fully withdrawn condition for bolt 20. The teeth 53 of gear 54 are illustrated as meshed in varying degrees with the rack 22.

Figure 6:
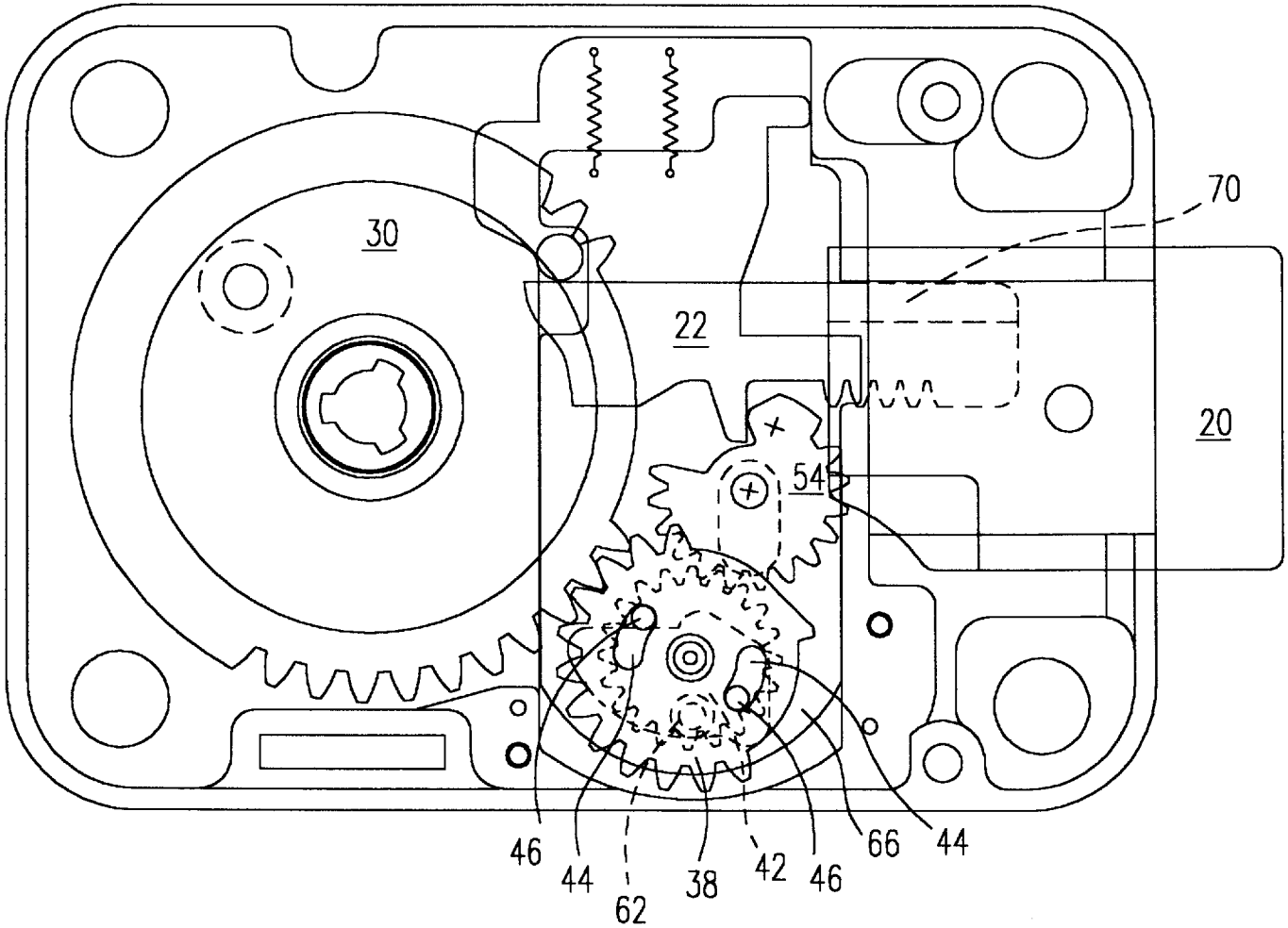

FIG. 6 illustrates the partial restoration of bolt 20 and the disengagement of partial gear 54 from rack 22. It should be noted that the rotation of drive cam 30 in the clockwise direction has caused a relative rotation of stepper motor gear 38 with respect to gear 42, thus shifting the pins 46 to the opposite end of slots 44. This permits roller follower 62 to hold slide 66 in its depressed position until bolt 20 is substantially completely extended. Slide 66 will be denied full restoration until abutment surface 68 clears blocking member 70.

Figure 7:
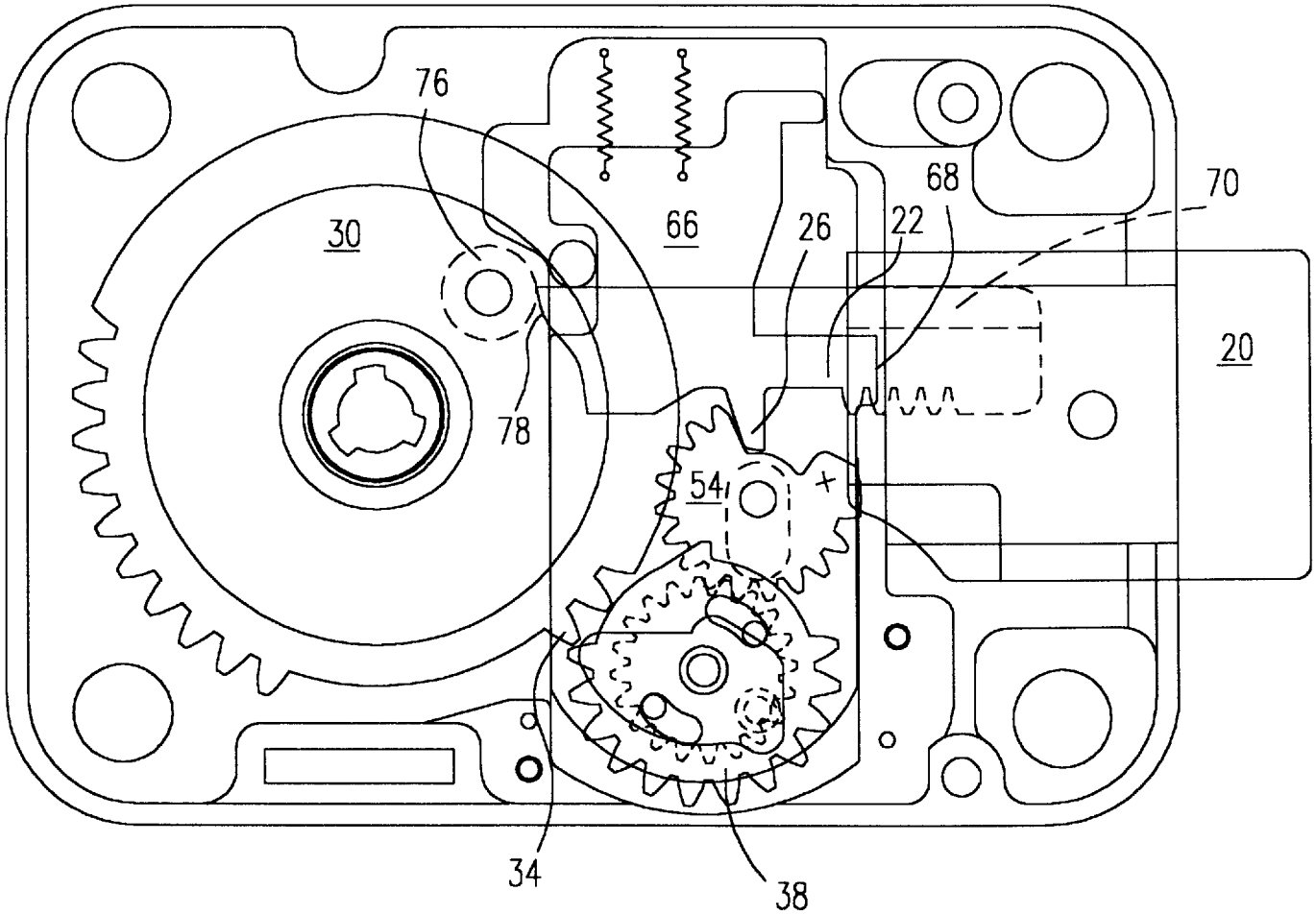

Referring now to FIG. 7, the bolt 20 is substantially restored, the stepper motor gear 38 is at the final stages of restoration by being positioned by gear teeth 34 on dial cam 30. As can be seen, with only a very slight additional rotation of drive cam 30, gear tooth 34 will disengage from stepper motor gear 38 and will be ineffective to fully restore bolt 20 to its completely extended position. Accordingly, roller follower 76 carried by drive cam 30 will engage the distal end 78 of rack 22 and provide the displacing drive to restore bolt 20 and rack 22. Prior to restoration of bolt 20 and rack 22 to its fully extended locked condition, slide 66 will be spring restored to its undisplaced position disposing abutting surface 68 in a blocking position relative to blocking member 70.

As one will appreciate, the above described mechanism acts to provide the benefits set forth in the Objects of the Invention and simultaneously provides an extremely secure and reliable method for the withdrawal and extension of the lock bolt 20.

One of ordinary skill in the art will recognize that the precise configuration of the parts contained herein may be varied while the resulting mechanism will remain within the scope of the appended claims. As an example, roller follower 76 could be replaced with a cam rise which would engage the end surface 78 of rack 22, and the configuration of the enlarged teeth 56 and enlarged teeth 26 on the partial gear 54 on rack 22, respectively, may be configured with alternate profiles and shapes.

We claim:

1. An electronic combination lock comprising:

a dial cam fixedly attached to a manually rotatable input;

a lock bolt;

a plurality of gear teeth disposed on said dial cam;

a gear drive meshing with said gear teeth;

said lock bolt comprising a rack disposed for meshing engagement with said gear drive; and a slide displaceable by a member on said gear drive, said slide disposed in blocking relation to said bolt in a first position and disposed in a position permitting bolt movement in a second position.

2. The electronic combination lock of claim 1 wherein said gear drive comprises a pair of coaxially disposed gears drivingly interconnected.

3. The electronic combination lock of claim 1 further comprising a second cam disposed on said dial cam and rotatable with said dial cam and engageable with said bolt for displacing said bolt to a fully extended position.

4. The electronic combination lock of claim 2 wherein said pair of coaxially disposed gears are further displaceable relative to each over a predetermined range of rotation.

5. The electronic combination lock of claim 1 wherein said bolt comprises a blocking member and said slide comprises a portion disposable out of interference with said blocking member whenever conditioned to permit bolt withdrawal and in interference with said blocking member whenever conditioned for insuring continued extension of said bolt.

* * * * *